United States Patent [19]

Ishino et al.

[11] Patent Number: 4,742,359

[45] Date of Patent: May 3, 1988

[54] ANTENNA SYSTEM

[75] Inventors: Ken Ishino, Chiba; Hisamatsu Nakano, Tokyo; Naohisa Gotoh, Kanagawa, all of Japan

[73] Assignee: TDK Corporation, Tokyo, Japan

[21] Appl. No.: 889,116

[22] Filed: Jul. 22, 1986

[30] Foreign Application Priority Data

| | | | |
|---|---|---|---|
| Aug. 5, 1985 | [JP] | Japan | 60-171101 |
| Aug. 5, 1985 | [JP] | Japan | 60-171102 |
| Aug. 5, 1985 | [JP] | Japan | 60-171103 |
| Aug. 5, 1985 | [JP] | Japan | 60-171104 |
| Aug. 5, 1985 | [JP] | Japan | 60-171105 |
| Aug. 5, 1985 | [JP] | Japan | 60-171106 |

[51] Int. Cl.[4] ..... H01Q 1/36

[52] U.S. Cl. ..... 343/895; 343/840

[58] Field of Search ..... 343/895, 840

[56] References Cited

U.S. PATENT DOCUMENTS 3,184,747 5/1965 Kach ..... 343/895

*Primary Examiner*—William L. Sikes
*Assistant Examiner*—Hoanganh Le
*Attorney, Agent, or Firm*—Martin M. Novack

[57] ABSTRACT

A parabolic antenna for SHF band having a primary feeder and a reflector is improved by using a backfire helical antenna as a primary feeder, which is fed by using a coaxial cable. The backfire helical antenna has a matching disc coupled with an outer conductor of the coaxial cable feeder, and a coil, one end of which is coupled with an inner conductor of said coaxial cable. The other end of the coil is free standing. The coil is positioned so that the axis of the coil coincides with the axis of the reflector, and the feed end of the coil locates nearer to the reflector than the free standing end of the coil. The present antenna is useful in particular for a receiving antenna for a direct satellite broadcasting.

12 Claims, 14 Drawing Sheets

ANTENNA SYSTEM

BACKGROUND OF THE INVENTION

The present invention relates to a parabolic antenna for circular polarized wave of a satellite broadcast system in SHF band (3 GHz–30 GHz) and, in particular, relates to a primary feeder for such an antenna. The present primary feeder relates in particular to a backfire helical antenna.

A conventional circular polarized wave antenna for SHF band has been disclosed in the Japanese patent laid open publication No. 93402/81, in which an endfire helical antenna is used as a primary feeder as shown in FIG. 1, in which the numeral 1 is a parabolic reflector. An endfire helical antenna 2 is located at the focal point of the reflector 1. The endfire helical antenna 2 is coupled with a coaxial cable 3 which functions as a feeder line.

However, an endfire helical antenna as shown in FIG. 1 has the disadvantage in structure, as a coaxial cable 3 must traverse a reflector surface, because the antenna 2 is fed at the far end from the reflector surface. Therefore, the coaxial cable 3 prevents the reflected wave path or blocks the wave, thus, that feeder line deteriorates the characteristics of the antenna itself. Further, the length of the coaxial cable 3 in that structure must be long, and the long feeder line increases the power loss of transmission signal. Further, the mechanical strength for supporting the endfire helical antenna together with the feeder line poses some problems to be solved in the prior art.

SUMMARY OF THE INVENTION

It is an object, therefore, of the present invention to overcome the disadvantages and limitations of a prior antenna by providing a new and improved antenna.

It is also an object of the present invention to provide a new and improved antenna which has a backfire helical antenna as a primary feeder to reduce power loss and blocking by a feeder line, and improve mechanical strength for supporting both the primary feeder and the feeder line.

The above and other objects are attained by an antenna system comprising a reflector, a primary helical antenna having a coil with a pair of ends located at focal point of said reflector so that axis of the helical antenna coincides essentially with axis of said reflector, a feeder line for coupling the antenna system with an external circuit, wherein said primary helical antenna is a backfire helical antenna coupled with said feeder line at nearer end from said reflector and the end of the helical antenna is free standing, and said feeder line is a coaxial cable.

BRIEF DESCRIPTION OF THE DRAWINGS

The foregoing and other objects, features, and attendant advantages of the present invention will be appreciated as the same become better understood by means of the following description and accompanying drawings wherein.

DESCRIPTION OF THE PREFERRED EMBODIMENTS

Figure 2:
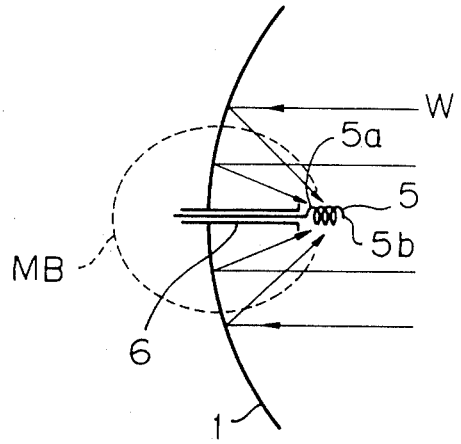
FIG. 2 shows the cross section of the parabolic antenna according to the present invention.

FIG. 2 shows the structure of the antenna system according to the present invention. In the figure, the numeral 1 is a parabolic reflector, on the focal point of which a backfire helical antenna 5 is positioned. The backfire helical antenna 5 is elongated coil in shape, having a pair of extreme ends 5*a* and 5*b*, and that antenna 5 is located along the axis of the reflector 1. One end 5*a* which is located close to the reflector 1 is the feeding point, and is coupled with a coaxial cable 6. The other end 5*b*, which is located farther from the reflector 1 than said end 5*a*, is free standing.

In that structure, microwave W is reflected by the reflector 1, and is concentrated to the primary feeder (backfire helical antenna) 5.

FIGS. 3A through 3D show some embodiments of the backfire antenna according to the present invention. In FIGS. 3A through 3D, the backfire helical antenna 5 is comprised of a conductive coil 8, coaxial cable 6, and a matching disc 7 which is coupled with an outer conductor 6A of the coaxial cable 6. The inner conductor 6B of the cable 6 is coupled with the coil 8 at the point 5*a*. The other end 5*b* of the coil 8 is free standing. The matching disc 7 is omitted in the embodiment of FIG. 3D.

Figure 1:
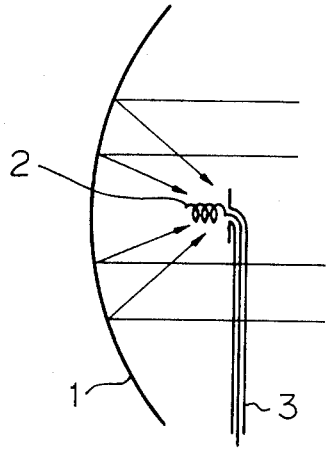
Fig. 1 PRIOR ART
FIG. 1 shows the structure of a prior parabolic antenna.
Figure 3A:
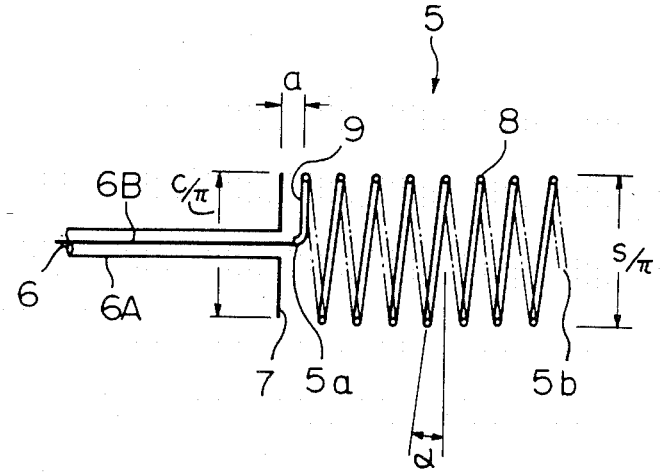
FIGS. 3A, 3B, 3C, and 3D show some embodiments of a primary feeder used in the antenna of FIG. 2.
Figure 3B:
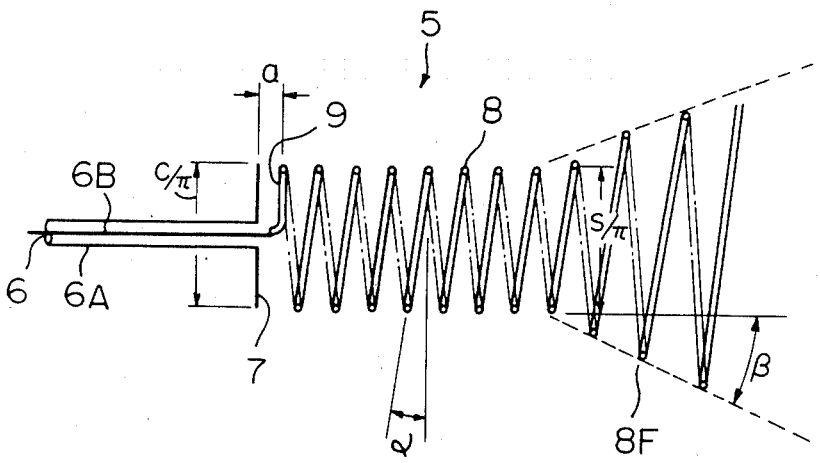
Figure 3C:
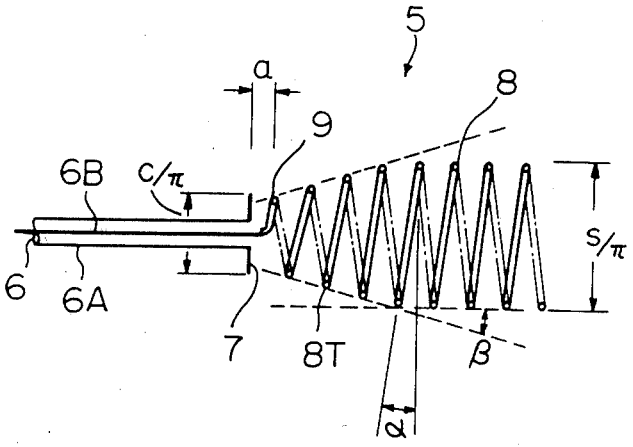
Figure 3D:
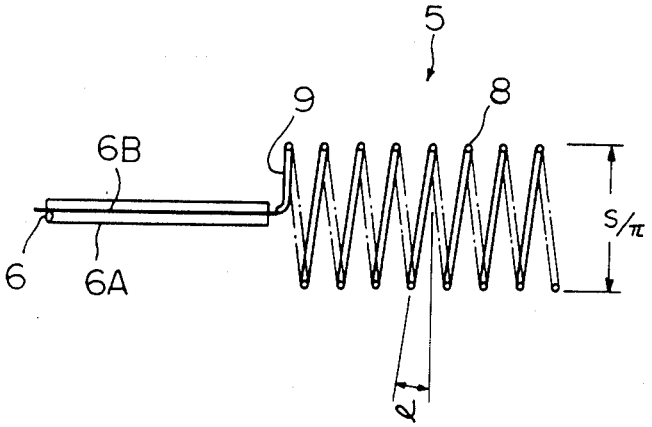

When a helical antenna 5 is coupled with a reflector, and that helical antenna is fed microwave signal at the feeding point, the current flows along the coil, and microwave energy is radiated from the free standing point of the coil. That is the operational principle of a prior endfire helical antenna of FIG. 1. In a prior helical endfire antenna, when the size of the reflector is small as compared with circumference length of the coil, the radiation is effected not only from the free standing point 5*b*, but also from the feeding point 5*a*. That is to say, when the size of a reflector is small, backlobe radiation increases. The present backfire helical antenna uses said backlobe radiation in a prior endfire helical antenna. The reflector in above explanation is called a matching disc in the present text. FIG. 3A is an embodiment wherein the coil 8 is a solenoid having a fixed diameter at the whole coil. In FIGS. 3B and 3C, at least a part of a coil 8 is tapered or flared. In FIG. 3D, a coil is a solenoid, but a matching disc is omitted. In those figures, the symbol S is the circumference length of a coil, ($\alpha$) is a pitch angle of the coil, c is the circumference length of the matching disc 7, and ($\beta$) is the angle of the taper 8T or the flare 8F. When a coil is tapered or flared, it is supposed that the length S is the circumference length of the coil at the portion where the it is not tapered nor flared. Of course, the diameter of the coil is $S/\pi$, and the diameter of the matching disc is $c/\pi$, where $\pi$ is 3.14.

It should be noted in FIGS. 3A through 3D that the coil 8 has the linear conductor 9 at the feeding point 5b. That linear conductor 9 is positioned parallel to the matching disc 7.

The spacing (a) between the matching disc 7 and said linear line 9 is critical for the preferable matching between the cable 6 and the coil 8 to reduce the V.S.W.R. (voltage standing wave ratio). The value of V.S.W.R. is minimized by adjusting said spacing (a). Alternatively, said V.S.W.R. is also adjusted by adjusting the taper angle ($\beta$). Of course the combination of the adjustment of the spacing (a), and the taper angle is possible.

Preferably, the center axis of the coil, and the inner conductor 6B of the cable 6 coincide with the axis of the reflector 1. In that location, the main lobe of the primary feeder 5 is shown by the dotted line MB in FIG. 2.

In operation, the microwave W in FIG. 2 received by the reflector 1 is reflected, and is focused at the focal point, on which the primary feeder (backfire helical antenna) is positioned. As the primary feeder has the main lobe as shown by the dotted line MB in FIG. 2, the reflected wave is received by the primary feeder 5. The antenna of FIG. 2 is useful in particular when the wave is a circular polarized wave.

The present backfire helical antenna has the advantage that the feeding point of the primary feeder is the nearer point 5a to the reflector 1, and therefore, the length of the coaxial cable 6 may be short. Accordingly, the power loss in a feeder line is small, and further, since the feeder line does not cross the reflector 1, the feeder line does not disturb the characteristics of the antenna. Further, it should be appreciated that the primary feeder 5 may be supported by the coaxial cable 6 itself, when a rigid coaxial cable or semi-rigid coaxial cable is used as a feeder line. Thus, the structure of the support of the primary feeder is simplified, and the support has sufficient mechanical strength. Further, as the structure is simplified, the present antenna is suitable for mass production.

Figure 4:
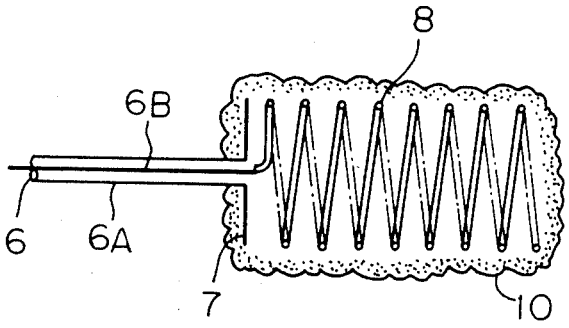
FIG. 4 shows the modification of a backfire helical antenna.
Figure 5:
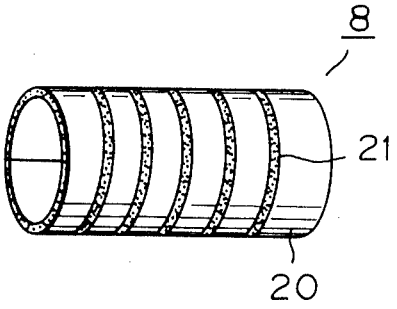
FIG. 5 shows the embodiment of a helical coil of the backfire helical antenna.

FIGS. 4 and 5 show some modifications of the present primary feeder.

In FIG. 4, the matching disc 7 and the coil 8 are covered with polystyrene foam 10 for water proofing of the antenna, and to prevent distortion of the antenna.

FIG. 5 shows the embodiment of the coil 8, in which a cylindrical dielectric bobbin 20 is provided, and a conductive pattern 21 is deposited on the bobbin 20 so that a coil is provided on the bobbin. The conductive pattern 21 is deposited on the bobbin through plating process, evaporation process, or etching process.

Some experimental curves of the present primary feeder are shown in FIGS. 6 through 9.

Figure 6:
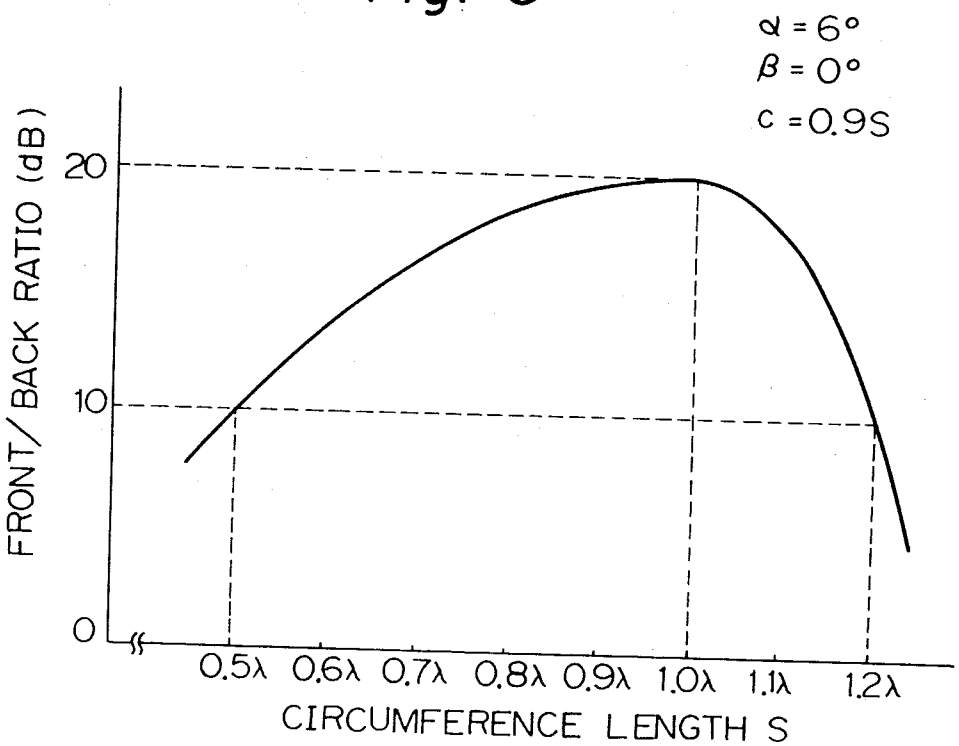
FIG. 6, FIG. 7, FIG. 8 and FIG. 9 show some experimental curves of the present backfire helical antenna.

FIG. 6 shows the curves between the circumference length S of a coil of a primary feeder, and the front-/back ratio of the radiation of the antenna. The vertical axis shows the front/back ratio 10 log(F/B), where F is the strength of main lobe, and B is the strength of back lobe. In FIG. 6, the angle ($\alpha$) is 6°, ($\beta$) is 0°, c is 0.9S, and ($\lambda$) is wavelength. It should be appreciated in FIG. 6 that it is preferable that S is in the range between 0.5($\lambda$) and 1.2($\lambda$) in order to provide the front/back ratio higher than 10 dB.

Figure 7:
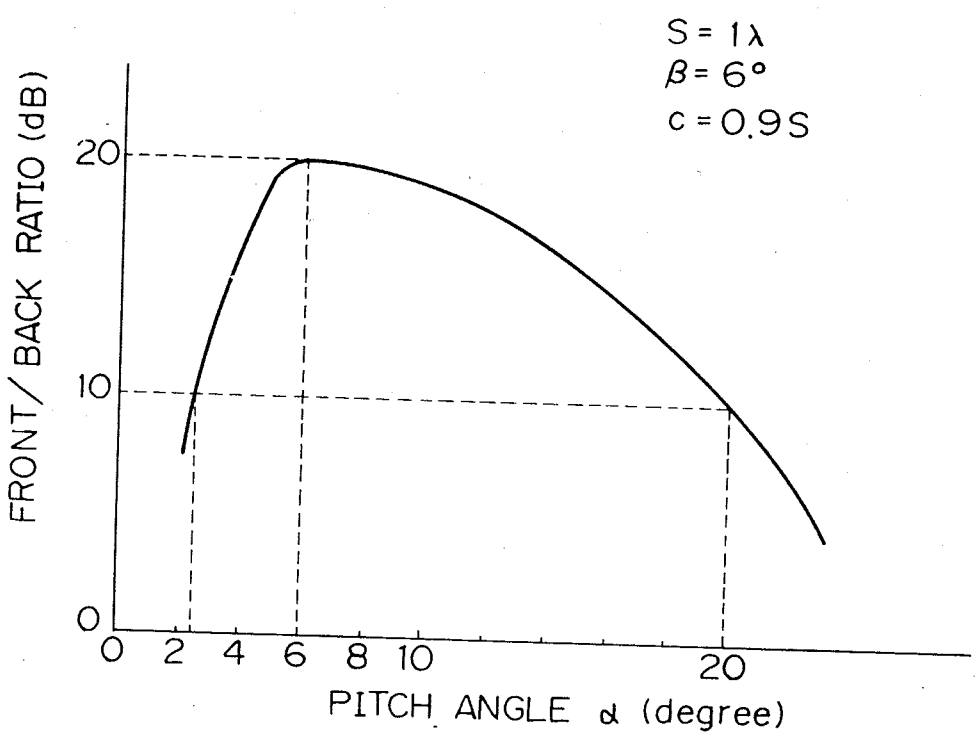

FIG. 7 shows the curves between the pitch angle ($\alpha$) and the front/back ratio of the backfire helical antennà, where S is 1.0($\lambda$), ($\beta$) is 6°, and c is 0.9 S. It should be appreciated in FIG. 7 that the preferable range of the pitch angle ($\alpha$) is between 3° and 20° in order to provide the front/back ratio higher than 10 dB.

Figure 8:
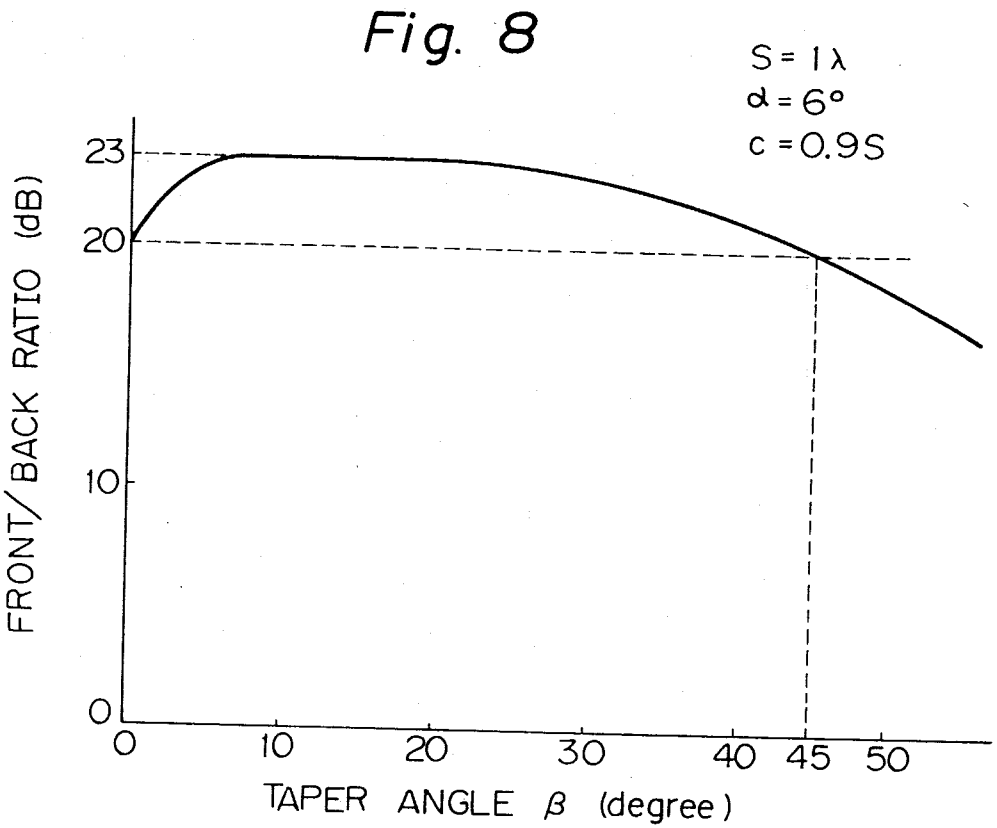

FIG. 8 shows the curves between the taper angle ($\beta$) or the flare angle, and the front/back radiation ratio of the backfire helical antenna, where S is 1.0 ($\lambda$), ($\alpha$) is 6°, c is 0.9S. It should be appreciated in FIG. 8 that the preferable range of ($\beta$) is between 0° and 45° in order to provide the front/back radiation ratio higher than 10 dB. The backfire helical antenna with ($\beta$)=0 has no taper or flare.

Figure 9:
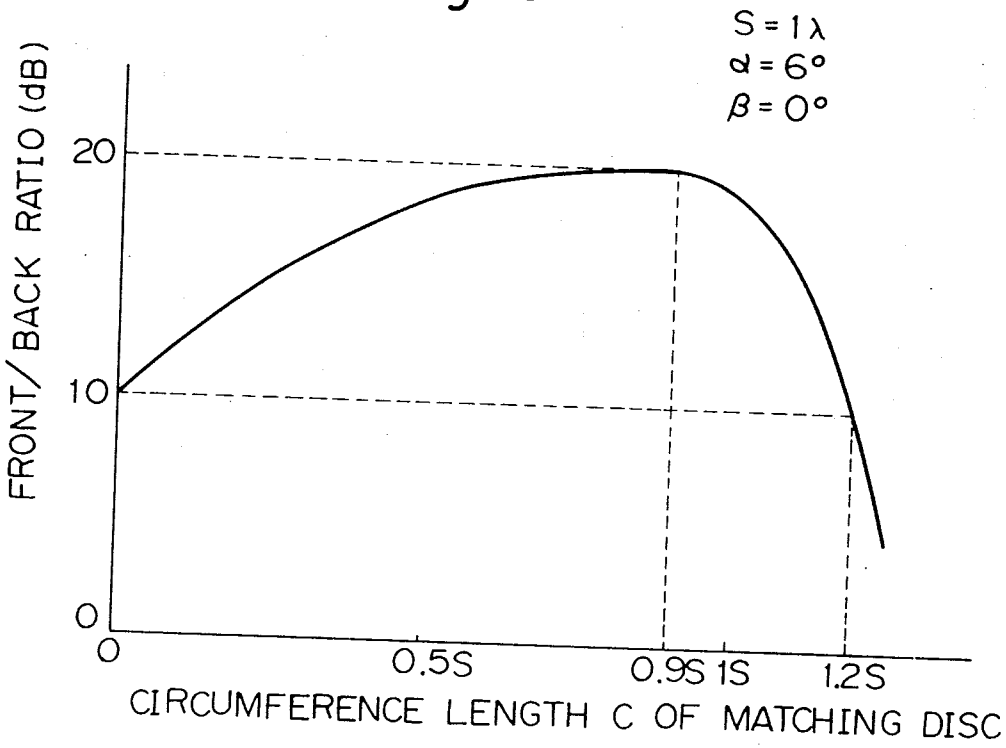

FIG. 9 shows the curves between the circumference length c of a matching disc and the front/back radiation ratio of the backfire helical antenna, in which S=1.0($\lambda$), ($\alpha$)=6°, ($\beta$)=0°. It should be appreciated in FIG. 9 that the preferable range of c is between 0 and 1.2 S, in which c=0 means that no matching disc is used.

Considering above experimental results in FIGS. 6 through 9, it should be appreciated that the following numerical limitations are preferable for a backfire helical antenna.

$$0.5(\lambda) \leqq S \leqq 1.2(\lambda)$$

$$3° \leqq (\alpha) \leqq 20°$$

$$0° \leqq (\beta) \leqq 45°$$

$$0 \leqq c \leqq 1.2S$$

Now, some modifications of the present invention for practical use are described.

Figure 10:
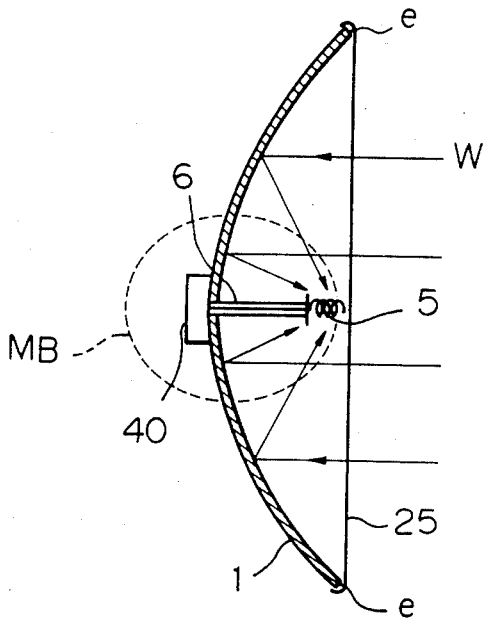
FIG. 10 shows the modification of the present backfire helical antenna.

FIG. 10 is the modification which has a radome 25 which covers the opening of the reflector 1. In the modification of FIG. 10, it is preferable that the focal point of the reflector 1 is within the line e-e of the extreme edge of the reflector 1. The numeral 40 is a BS converter for converting frequency between radiowave frequency and intermediate frequency, and said converter is fixed at the back of the reflector 1. The radome 25 is made of a plastic sheet which does not disturb microwave energy. The radome 25 is useful for water proofing of the antenna, and in particular, it is useful for the antenna which has the backfire primary feeder because no feeder line goes through the radome. In a prior antenna, a feeder line would go through a radome, and the water proofing would not be sufficient, even if a radome is used.

Figure 11A:
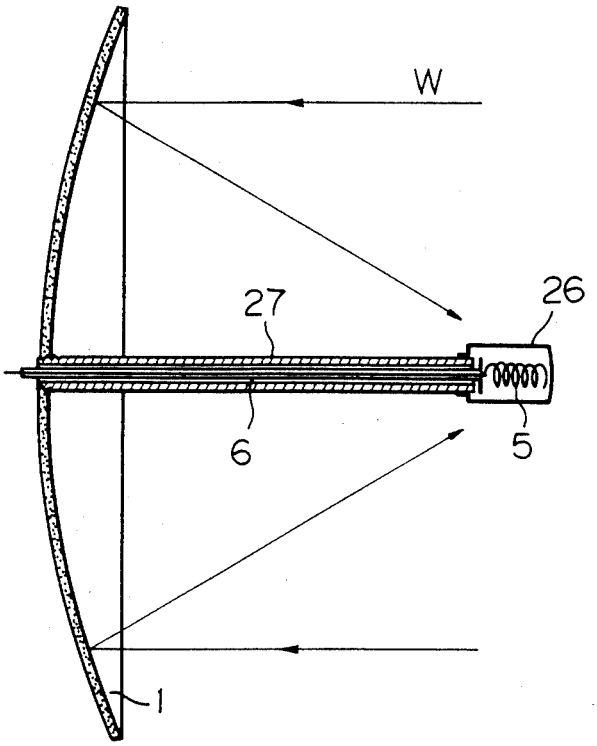
FIGS. 11A and 11B show other modifications of the present backfire helical antenna.

FIG. 11A is another modification of the present antenna, in which the primary feeder (backfire helical antenna) is covered with the radome 26, and the coaxial cable 6 is supported by a hollow cylindrical stay 27. The stay 27 itself is fixed to the reflector 1 by using a screw. The stay 27 has an elongated hole, in which a feeder line is secured so that the feeder line is protected by the stay 27. The modification of FIG. 11A is useful when the focus length of the reflector 1 is too long to support the coaxial cable 6 by the feeder line itself.

Preferably, at least the surface of the stay 27 is made of conductive material. If the stay 27 is dielectric, the electromagnetic field is disturbed, and the characteristics of the antenna are deteriorated.

Figure 11B:
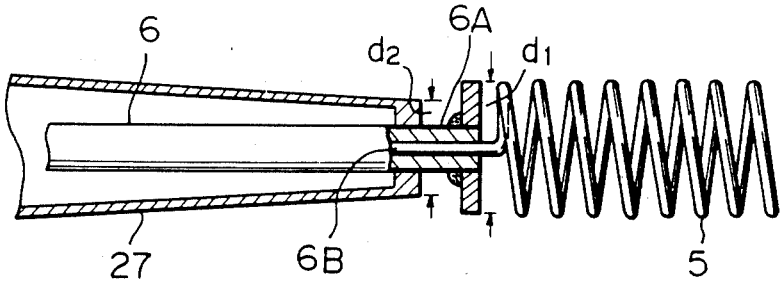

FIG. 11B is further modification of FIG. 11A. In FIG. 11B, the stay 27 is tapered so that the diameter $d_2$ of the stay 27 at the junction with the antenna 5 is smaller than the diameter $d_1$ of the matching disc 7 of the antenna 5. Further, it should be noted that the tapered stay improves the mechanical strength of the stay, since the stay is coupled with the reflector at the thick portion of the stay.

Figure 12A:
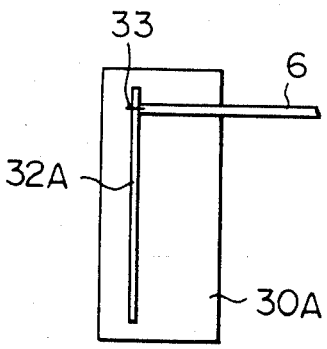
FIGS. 12A, 12B and 12C show still other modifications of the present backfire helical antenna.
Figure 12B:
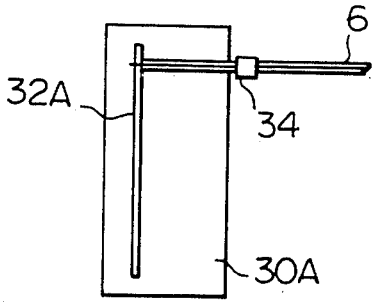
Figure 12C:
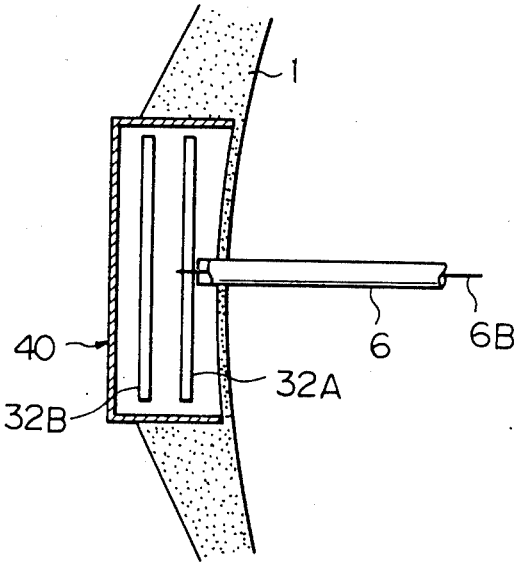

FIGS. 12A, 12B and 12C concern the modifications for coupling the coaxial cable 6 with an external circuit like a BS converter (frequency converter). As the present antenna is fed by using a coaxial cable, without using a waveguide, the feeder line is directly coupled with a printed circuit board. In FIG. 12A, the inner conductor of the coaxial cable 6 is coupled with the pin 33 on the printed circuit board 32A. The outer conductor of the coaxial cable 6 is coupled with the ground pattern of the printed circuit board 32A. The numeral 30A is the housing of a frequency converter which secures the printed circuit board 32A.

FIG. 12B is another modification, in which a coaxial cable connector 34 is fixed to the housing 30A. The coaxial cable 6 is coupled with the printed circuit board 32A by using the coaxial cable connector 34.

FIG. 12C is further modification of FIG. 12A. In FIG. 12C, the frequency converter 40 is fixed at the back of the reflector 1. The frequncy converter 40 has printed circuit boards 32A and 32B, and the coaxial cable 6 is fixed directly to the printed circuit board 32A. That is to say, both the inner conductor and the outer conductor of the coaxial cable 6 are coupled directly with the printed circuit board. The structure of FIG. 12C is advantageous for decreasing the size of the antenna and the related external circuit, and also reducing the loss in the feeder line.

Figure 13:
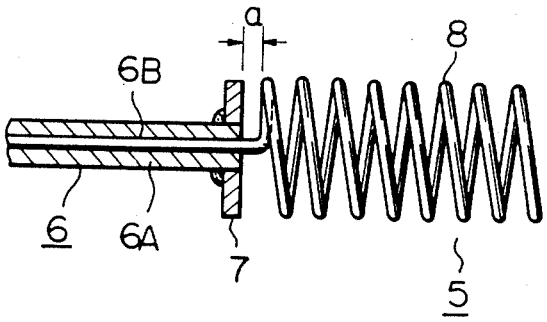
FIGS. 13 and 14 show still other modifications of the present backfire helical antenna.

FIG. 13 is the modification of the coil 8 of the backfire helical antenna 5. The feature of FIG. 13 is that the coil 8 is integral with the inner conductor 6B of the coaxial cable 6. That is to say, the coil 8 is made by winding the inner conductor of the coaxial cable. The structure of FIG. 13 has the advantage that the mechanical strength of the antenna is high because the coil 8 is integral with the coaxial cable, and that the manufacturing process for coupling the coil 8 with the coaxial cable is removed.

Figure 14:
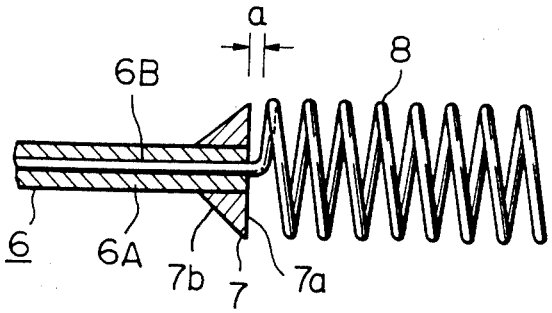

FIG. 14 is the modification of the structure of the matching disc 7. The feature of the matching disc 7 of FIG. 14 is that the matching disc 7 is not a flat disc, but has a flat surface 7*a*, and a tapered back surface 7*b*. The flat surface 7*a* faces with the coil 8. The tapered portion 7*b* of the disc 7 facilitates the rigid coupling of the disc 7 with the coaxial cable 6. As the disc 7 is tapered, it is electro-magnetically thin, but mechanically thick. That is to say, if the disc 7 is thick, it would disturb the flux, and would deteriorate the characteristics of the antenna. As the disc 7 of FIG. 14 is tapered, it does not deteriorate the characteristics of the antenna, and at the same time, the tapered disc is mechanically equivalent to the thick disc to improve mechanical strength.

Figure 15A:
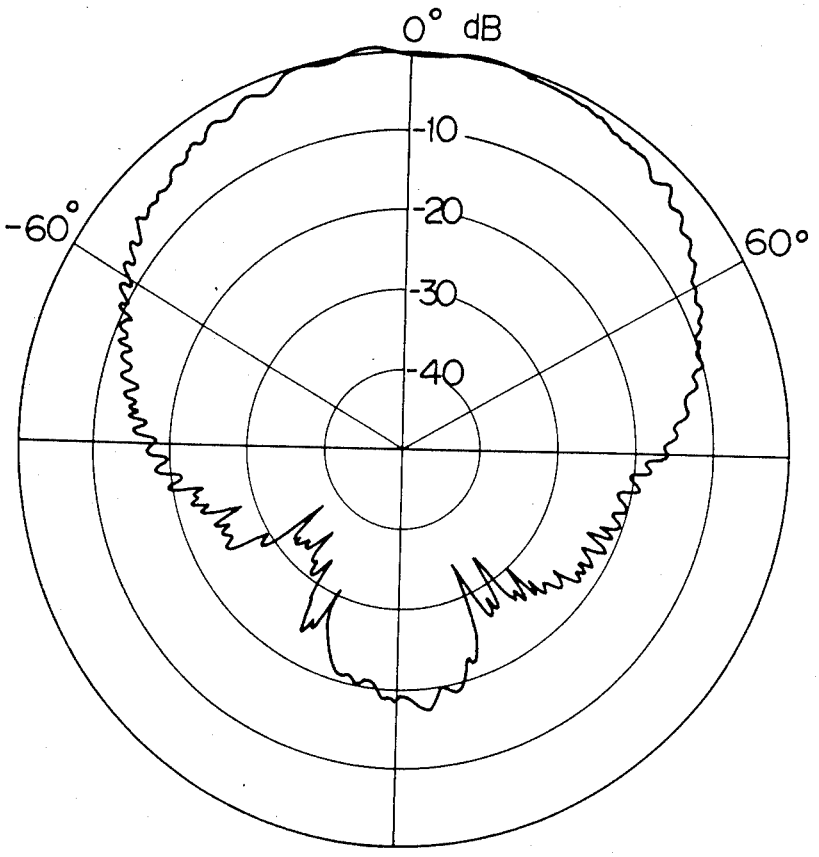
FIGS. 15A, 15B and 15C show experimental results of the present backfire helical antenna, and the antenna system using that backfire helical antenna.
Figure 15B:
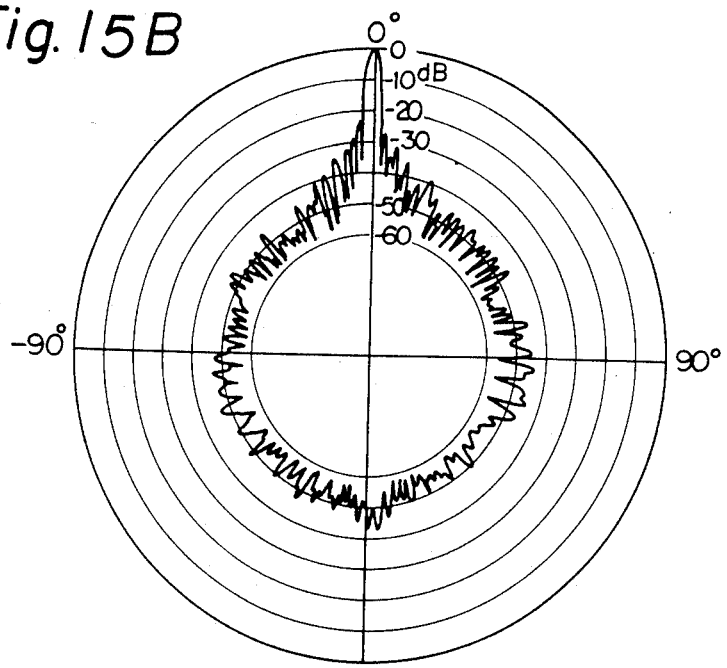
Figure 15C:
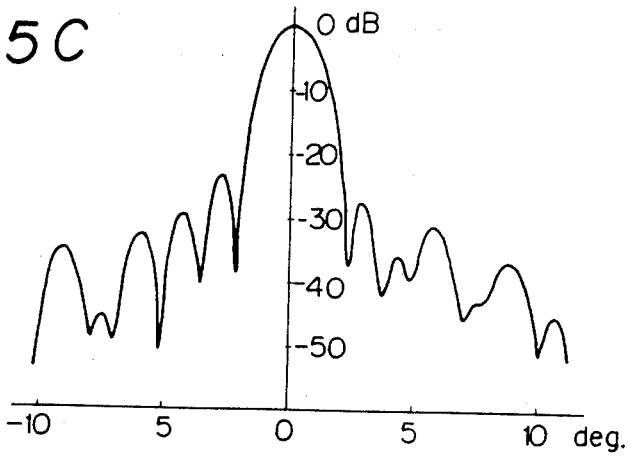

Finally, the experimental curves are shown in FIGS. 15A through 15C. The test sample of the backfire helical antenna, has an integral coil of FIG. 13, and a tapered matching disc of FIG. 14, but a coil is not tapered nor flared. The number of turns of the coil is 7, the frequency is 12 GHz, and the diameter of the reflection is 750 mm.

FIG. 15A shows the gain curves of the primary feeder (without using a reflector). In the experiment, the gain of the main lobe is 6.3 dB, the V.S.W.R. is 1.17, the front/back ratio is 17 dB, and the gain in the ±60° direction is −8 dB.

FIG. 15B shows the gain curves of the whole antenna which has both the primary feeder, and the parabolic reflector, and FIG. 15C is the detailed curves near the main lobe of FIG. 15B. In FIGS. 15B and 15C, the gain is 37.5 dB, the half-width (3 dB down) is about 2 degrees, the side lobe level is lower than −23 dB, and the back lobe level is lower than −45 dB.

From the foregoing, it will now be apparent that a new and improved antenna having a primary backfire antenna has been discovered. It should be understood of course that the embodiments disclosed are merely illustrative and are not intended to limit the scope of the invention. Reference should be made to the appended claims, therefore, rather than the specification as indicating the scope of the invention.

What is claimed is:

1. An antenna system comprising a reflector, a primary feeder having a helical coil with a pair of ends located at the focal point of said reflector so that the axis of the helical coil coincides essentially with the axis of said reflector, and a feeder line for coupling the antenna with an external circuit, wherein the improvement comprises;

said primary feeder is a backfire helical antenna coupled with said feeder line at its end nearer said reflector and the other end of the backfire helical antenna being free standing, said feeder line being a coaxial cable, a conductive matching disc at the junction point of the feeder line and the helical antenna, said matching disc being coupled with the outer conductor of said coaxial cable, and said coil being coupled with the inner conductor of said coaxial cable, and the wherein following numerical conditions are satisfied:

$$0.5(\lambda) \leqq S \leqq 1.2\ (\lambda)$$

$$3^\circ \leqq (\alpha) \leqq 20^\circ$$

$$0^\circ \leqq (\beta) \leqq 45^\circ$$

$$0 \leqq c \leqq 1.2S$$

where S is the circumference length of one turn of the coil, ($\alpha$) is the pitch angle of the coil, ($\beta$) is the flare angle of the coil, and c is the circumference length of the matching disc.

2. An antenna system according to claim 1, wherein said coaxial cable is located along the center axis of said reflector, and penetrates the reflector at the center of the same.

3. An antenna system according to claim 1, wherein said backfire helical antenna is covered with polystyrene foam.

4. An antenna system according to claim 1, wherein said coil has a cylindrical dielectric bobbin, and a conductive pattern deposited on the surface of said bobbin to provide a coil.

5. An antenna system according to claim 1, wherein the opening of said reflector is closed by a radome.

6. An antenna system according to claim 1, wherein said coaxial cable is supported by a hollow cylindrical stay, and the backfire helical antenna is covered with a feedome.

7. An antenna system according to claim 6, wherein at least a surface of said stay is dielectric, and the diameter ($d_2$) at the end which faces with the matching disc is smaller than the diameter ($d_1$) of the matching disc.

8. An antenna system according to claim 1, wherein said coaxial cable is connected to a printed circuit board of a frequency converter.

9. An antenna system according to claim 8, wherein said frequency converter is fixed at the back of the reflector.

10. An antenna system according to claim 1, wherein said coil has a linear portion at the junction point between the coil and the feeder line, and the coil is located so that said linear portion is parallel to the matching disc.

11. An antenna system according to claim 1, wherein said coil is integral with the inner conductor of the feeder line.

12. An antenna system according to claim 1, wherein said matching disc has a flat surface facing with the coil, and a tapered back surface.

* * * * *